US009839571B2

(12) United States Patent
Pan

(10) Patent No.: US 9,839,571 B2
(45) Date of Patent: Dec. 12, 2017

(54) FOLDABLE ROLLATOR

(71) Applicant: GENTEEL HOMECARE PRODUCTS CO. LTD., Foshan (CN)

(72) Inventor: Shihuang Pan, Foshan (CN)

(73) Assignee: GENTEEL HOMECARE PRODUCTS CO. LTD., Liyu Industry Area, Danzao Town, Nanhai District, Foshan, Guangdong Province (CN)

( * ) Notice: Subject to any disclaimer, the term of this patent is extended or adjusted under 35 U.S.C. 154(b) by 0 days.

(21) Appl. No.: 15/269,482

(22) Filed: Sep. 19, 2016

(65) Prior Publication Data

US 2017/0100299 A1 Apr. 13, 2017

(30) Foreign Application Priority Data

Oct. 9, 2015 (CN) ..... 2015 2 0780917 U
Oct. 30, 2015 (CN) ..... 2015 2 0864997 U

(51) Int. Cl.
*A61H 3/04* (2006.01)
*A47C 4/04* (2006.01)

(52) U.S. Cl.
CPC ..... *A61H 3/04* (2013.01); *A47C 4/04* (2013.01); *A61H 2003/046* (2013.01)

(58) Field of Classification Search
CPC ..... A61H 3/04; A47C 4/04
See application file for complete search history.

(56) References Cited

FOREIGN PATENT DOCUMENTS

NL EP 3095431 A1 * 11/2016 ..... A61H 3/04

* cited by examiner

*Primary Examiner* — John Walters
*Assistant Examiner* — James Triggs
(74) *Attorney, Agent, or Firm* — Miller, Matthias & Hull LLP

(57) ABSTRACT

A foldable rollator is disclosed, including a folding device, a first rollator body and a second rollator body arranged in a mirror image orientation with respect to one another. The first and second rollator bodies are movably connected with each other through the folding device. Each of the first and second rollator bodies include a gripping part including a supporting bar, a drawing device, and a supporting fastener. The drawing device is positioned on the supporting bar away from the supporting fastener. The gripping part is rotatably connected to the supporting fastener. The supporting fastener is provided with a first and second clamping grooves and the gripping part is orientated perpendicular to and fixed to the supporting fastener when the drawing device is clamped in the first clamping groove. The gripping part is rotationally connected to the supporting fastener when the drawing device is clamped in the second clamping groove.

16 Claims, 10 Drawing Sheets

FOLDABLE ROLLATOR

FIELD

The present disclosure relates generally to the technical field of rehabilitation-assisted instrument, and specifically to a foldable rollator.

BACKGROUND

At present, with the population aging in China, the aged people are increasing gradually. For these aged people, especially those suffering from mobility problems caused by disease, they have more and more difficulties in walking since their physical functions are gradually decreasing. In this case, there is an increasing demand for a portable and sturdy walker which is convenient to park. However, most walkers on the market are only able to be folded only once, causing huge sizes, so these walkers are not convenient for carrying, transportation and storage. In order to address the above problem, some walkers that can be folded secondly are presented. However, for such walker, the secondary folding generally requires the user to bend down and squat to adjust a switch to do the folding operation. Such action is very difficult for normal users, especially aged people who have difficulties in walking, and meanwhile, there is a potential safety problem.

SUMMARY

Based on this, an objective of the present disclosure is to provide a foldable rollator, which is convenient for secondary folding, and easy to operate to save physical power, with safety and durability, in order to overcome the defects in the prior art.

According to the objective of the present disclosure, a foldable rollator is provided, including a folding device, a first rollator body and a second rollator body both of which are arranged in a mirror mode with respect to each other and movably connected with each other through the folding device, wherein each of the first and second rollator bodies includes a gripping part, a drawing device and a supporting fastener, the gripping part includes a supporting bar, the drawing device is arranged on the supporting bar and positioned away from the supporting fastener, the gripping part is rotatably connected to the supporting fastener, the supporting fastener is provided with a first clamping groove and a second clamping groove, the gripping part is perpendicular to and fixed to the supporting fastener when the drawing device is clamped in the first clamping groove, and the gripping part is rotationally connected to the supporting fastener when the drawing device is clamped in the second clamping groove.

The technical solution according to the present disclosure will be further explained as below.

In one embodiment, the folding device includes a first connecting rod, and a second connecting rod rotatably fixed to the first connecting rod, the first connecting rod and the second connecting rod are arranged to cross each other, both ends of the first connecting rod are rotatably fixed to the first rollator body and the second rollator body respectively, and both ends of the second connecting rod are rotatably fixed to the first rollator body and the second rollator body respectively.

In one embodiment, the gripping part includes a hand grip, the supporting bar includes an inner supporting bar and an outer supporting bar, the outer supporting bar is a hollow tubular structure, the inner supporting bar is slidably fixed inside the outer supporting bar, and the hand grip is fixed on the inner supporting bar and positioned on an end of the inner supporting bar away from the outer supporting bar.

In one embodiment, the gripping part further includes a rotating member detachably fixed on an end of the outer supporting bar, the rotating member is provided with an annular slot, the annular slot is arranged on an end of the rotating member close to the outer supporting bar, and the outer supporting bar is clamped in the annular slot.

In one embodiment, the rotating member is provided with a long hole and a sliding groove, the drawing device includes a drawing handle fixed on the outer supporting bar, a drawing bar arranged inside the sliding groove and connected to the drawing handle, a spring arranged inside the long hole and connected to the drawing bar, and a detent connected to the spring.

In one embodiment, the supporting fastener is provided with a curved groove fitted with the rotating member, each of both inner walls of the curved groove is provided with the first clamping groove and the second clamping groove respectively, each of the both inner walls of the curved groove is further provided with an arc segment, and the first clamping groove and the second clamping groove are connected with each other through the arc segment.

In one embodiment, each of both outer sides of the rotating member is provided with a convex part respectively, a side wall of the curved groove is provided with a mounting through hole, and the convex part is rotatably fixed inside the mounting through hole.

In one embodiment, a long groove penetrating the rotating member is arranged near the convex part, the detent is slidably arranged in the long groove, both ends of the detent extend out of the long groove, and the long hole, the sliding groove and the long groove are in communication with each other sequentially.

In one embodiment, the foldable rollator further includes a supporting platform including a first supporting tube, a second supporting tube arranged oppositely to the first supporting tube, and a flexible supporting member fixed on the first supporting tube and the second supporting tube, the first supporting tube and the second supporting tube are fixed on the folding member, and the flexible supporting member is provided with a drawing part.

In one embodiment, the foldable rollator further includes wheels, and a braking device arranged on the gripping part, the gripping part further includes a braking handle, and the braking device includes a braking housing, a clamp housing, a clamp, a limit push rod, a braking rod, a braking pad and a braking component;

one end of the braking component is connected to the braking handle, the other end of the braking component is connected to the clamp housing, the braking pad cooperates with the wheels, the clamp housing is arranged inside the braking housing, the clamp is arranged inside the clamp housing, the clamp housing includes a first housing and a second housing in threaded connection with each other, an inverted-conical cavity is arranged at the bottom of the interior of the clamp housing, the clamp is provided with an inverted-conical part matching with the inverted-conical cavity, the limit push rod is arranged at the bottom of the interior of braking housing, one end of the braking rod is arranged inside the clamp housing, and the other end of the braking rod is connected to the braking pad; when the braking device is in a first state, one end of the limit push rod abuts against the clamp, and is positioned inside the clamp housing, the inverted-conical cavity is separated from the inverted-conical part, and the clamp is opened; and when the braking device is in a second state, the limit push rod is separated from the clamp and positioned outside the clamp housing, the inverted-conical cavity matches with the inverted-conical part, and the clamp is closed to clamp the braking rod.

In one embodiment, a clamp pressure bar and a first compression spring are further arranged inside the clamp housing, the clamp pressure bar is arranged between the clamp and the first compression spring, and both ends of the first compression spring abut against the clamp pressure bar and the second housing respectively.

In one embodiment, a second compression spring is further arranged inside the braking housing, the second compression spring is sleeved on the second housing, and both ends of the second compression spring abut against the first housing and the braking housing respectively.

In one embodiment, a limit step is arranged inside the braking housing, one end of the limit push rob abutting against the clamp is arranged above the limit step, and the bottom of the first housing abuts against the limit step.

In one embodiment, a flange is provided on the periphery of the limit push rob, and a fixing groove matching with the flange is arranged at the bottom of the interior of the braking housing.

In one embodiment, the clamp includes a first clamping part and a second clamping part arranged in a symmetrical manner, a clamping portion is arranged on an opposite side of each of the first clamping part and the second clamping part respectively, and the first clamping part and the second clamping part match with each other to clamp the braking bar.

In one embodiment, the braking housing includes a first braking housing and a second barking housing arranged in a symmetrical manner.

The present disclosure has the following advantages.

The primary folding of the above foldable rollator in the transverse direction can be implemented by the folding device. Then the secondary folding of the above foldable rollator can be implemented by a user who is in standing through operating the drawing device fixed on the gripping part with the user's fingers so that the gripping part rotates from the first clamping groove to the second clamping groove about the supporting fastener to engage with the supporting fastener. In this way, it avoids the requirement of the user to bend down and squat to do the similar operations, which spends too much physical power. The folding operations of such foldable rollator is very convenient for the user, especially aged people who have difficulties in walking, which saves physical power and is safe and reliable, to remove potential security problems.

DESCRIPTION OF REFERENCE SIGNS

Figure 1:
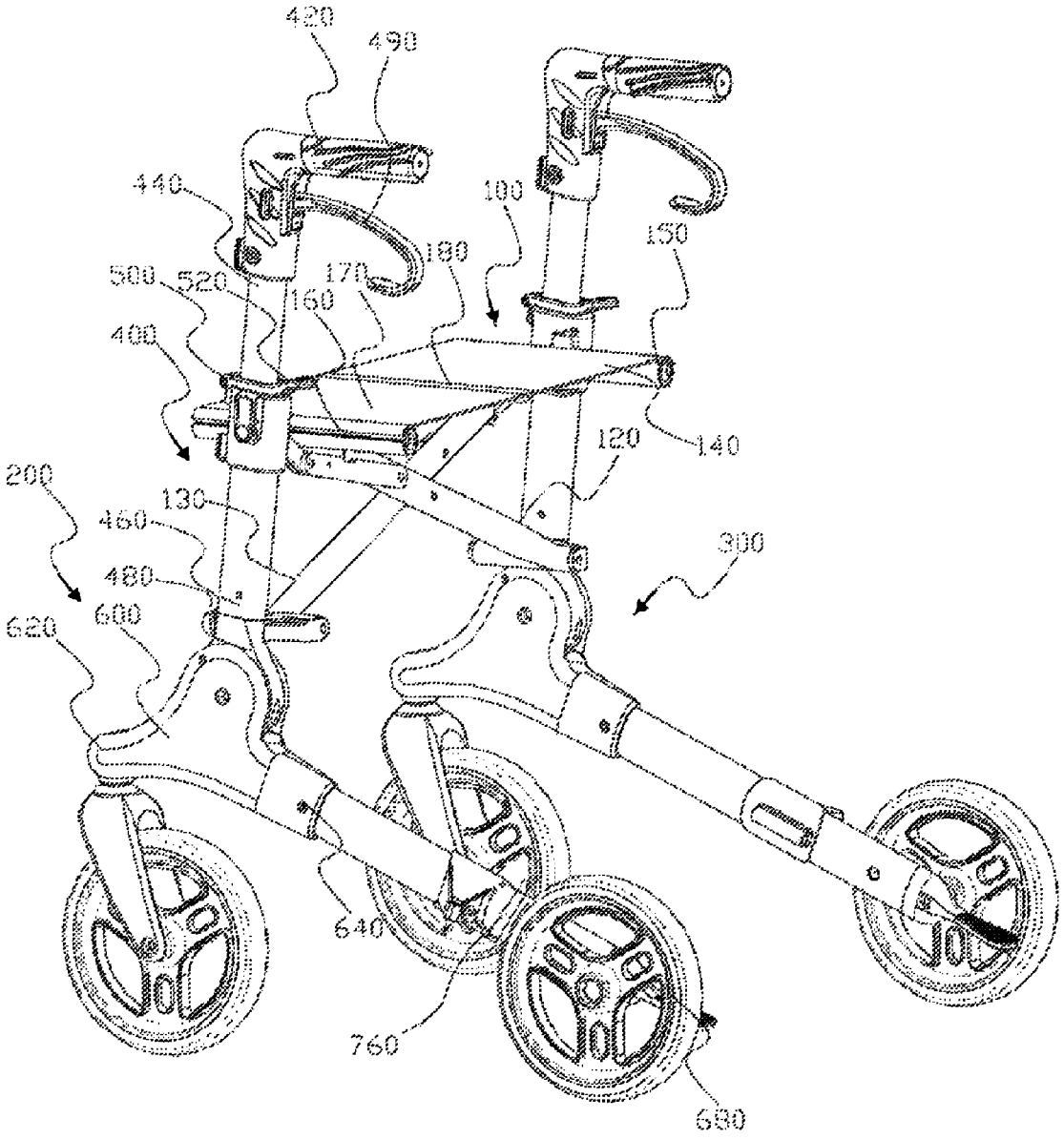
FIG. 1 is a structural schematic diagram illuminating a foldable rollator according to one embodiment of the present disclosure.

100 folding device, 120 first connecting rod, 130 second connecting rod, 140 supporting platform, 150 first supporting tube, 160 second supporting tube, 170 flexible supporting member, 180 drawing part, 200 first rollator body, 300 second rollator body, 400 gripping part, 420 hand grip, 440 inner supporting bar, 460 outer supporting bar, 480 rotating member, 482 convex part, 484 long groove, 485 annular slot, 486 long hole, 487 sliding groove, 490 braking handle, 500 drawing device, 520 drawing handle, 540 drawing bar, 560 spring, 580 detent, 600 supporting fastener, 620 fixed part for front-wheel, 640 fixed part for rear-wheel, 660 curved groove, 662 first clamping groove, 664 arc segment, 666 second clamping groove, 670 mounting through hole, 680 wheel, 700 braking device, 712 second compression spring, 714 limit step, 720 clamp housing, 722 inverted-conical cavity, 724 clamp pressure bar, 726 first compression spring, 727 first housing, 728 second housing, 730 clamp, 732 inverted-conical part, 734 first clamping part, 736 second clamping part, 740 limit push rod, 750 braking rob, 760 braking pad, and 777 braking component.

DETAILED DESCRIPTION OF THE PREFERRED EMBODIMENTS

In the following description of embodiments, reference is made to the accompanying drawings which form a part hereof, and in which it is shown by way of illustration specific embodiments of the disclosure that can be practiced. It is to be understood that other embodiments can be used and structural changes can be made without departing from the scope of the disclosed embodiments.

As shown in FIGS. 1 and 4-6, a foldable rollator is provided, including a folding device 100, a first rollator body 200 and a second rollator body 300 both of which are arranged in a mirror image orientation with respect to each other and movably connected with each other through the folding device 100. Each of the first and second rollator bodies 200, 300 includes a gripping part 400, a drawing device 500 and a supporting fastener 600, the gripping part 400 includes a supporting bar, the drawing device 500 is arranged on the supporting bar and positioned away from the supporting fastener 600, the gripping part 400 is rotatably connected to the supporting fastener 600, the supporting fastener 600 is provided with a first clamping groove 662 and a second clamping groove 664, when the drawing device 500 is clamped in the first clamping groove 662, the gripping part 400 is perpendicular to and fixed to the supporting fastener 600, and when the drawing device 500 is clamped in the second clamping groove 600, the gripping part 400 is rotationally connected to the supporting fastener 600.

The primary folding of the above foldable rollator can be implemented by the folding device. Specifically, the first rollator body 200 and the second rollator body 300 may be folded and fit together in the transverse direction through the folding device 100, when the user only draws the middle position of the folding device 100. Since the drawing device 500 is arranged on the supporting bar and positioned on one end of the supporting bar away from the supporting fastener 600, that is, the drawing device 500 is arranged at a position very close to the hand of the user, when the gripping part 400 is clamped in the first clamping groove 662, that is the gripping part 400 is perpendicular to and fastened on the supporting fastener 600, the foldable rollator is in use, and when the user is in a standing posture, the secondary folding of the foldable rollator in the longitudinal direction can be implemented by drawing and operating the drawing device 500 fixed on the gripping part 400 with the user's fingers so that the gripping part 400 rotates from the first clamping groove 662 to the second clamping groove 66 about the supporting fastener 600 to be close to the supporting fastener 600 and engage with the supporting fastener 600. In this way, it avoids the requirement of the user to bend down and squat to do the similar operations, which spends too much physical power. The folding operations of such foldable rollator is very convenient for the user, especially aged people who have difficulties in walking, which saves physical power and is safe and reliable, to remove potential security problems.

As an alternate embodiment, the drawing device for the secondary folding of the foldable rollator may be arranged on the hand grip 420, which may further facilitate the standing operation, to improve the convenience of the use of the foldable rollator, leading to a better user experience.

The folding device 100 includes a first connecting rod 120, and a second connecting rod 130 rotatably fixed to the first connecting rod 120. The first connecting rod 120 and the second connecting rod 130 are arranged to cross each other, both ends of the first connecting rod 120 are rotatably fixed to the first rollator body 200 and the second rollator body respectively 300, and both ends of the second connecting rod 130 are rotatably fixed to the first rollator body 200 and the second rollator body 300 respectively. In this preferred embodiment, each of the first connecting rod 120 and the second connecting rod 130 is composed of segments of certain rod pieces. The connection of these rod pieces may be implemented through pins in a rotatable manner. The first connecting rod 120 and the second connecting rod 130 intersect one another to form an X shape The first connecting rod 120 and the second connecting rod 130 are connected and held together using the pins inserted through each of the first connecting rod 120 and the second connecting rod. Meanwhile both ends of each of the first connecting rod 120 and the second connecting rod 130 are fixed on the first rollator body 200 and the second rollator body 300 respectively. When a user draws the middle position of the folding device 100, the first rollator body 200 and the second rollator body 300 may be folded and fit together in the transverse direction through the rotation and fitting of the first connecting rod 120 and the second connecting rod 130 with respect to each other. The advantage of such design is that it is very convenient for folding and fitting the first and second rollator bodies together through the connecting rod structure to achieve the primary folding of the foldable rollator in the transverse direction, without assembling and disassembling any member. In addition, such folding structure is easy for operation, and low in cost.

The above folding device further includes a supporting platform 140 including a first supporting tube 150, a second supporting tube 160 arranged oppositely to the first supporting tube 150, and a flexible supporting member 170 fixed on the first and second supporting tubes 150, 160, the first and second supporting tubes 150, 160 are fixed on the folding member 100, and the flexible supporting member 170 is provided with a drawing part 180. The primary folding may be implemented by the user through drawing the drawing device 180 to drive the first and second supporting tubes 150, 160 so that the first connecting rod 120 and the second connecting rod 130 move towards each other to close up. When the foldable rollator is in the folding state, the flexible supporting member 170 is fixed between the first and second supporting tubes 150, 160, so as to hang below the first and second supporting tubes 150, 160 or lie on the first and second supporting tubes 150, 160. This allows greatly saving space. When the foldable rollator is unfolded in use, the flexible supporting member 170 is rotatably unfolded through the first and second supporting tubes 150, 160, to become a form of supporting structure for the supporting platform 140, which facilitates the user who is tired after a long walk to take a rest through sitting on the supporting platform 140, or facilitates the storage of some everyday items, such as water bottle, key and access card, without carrying them, so as to lighten loads.

Figure 2:
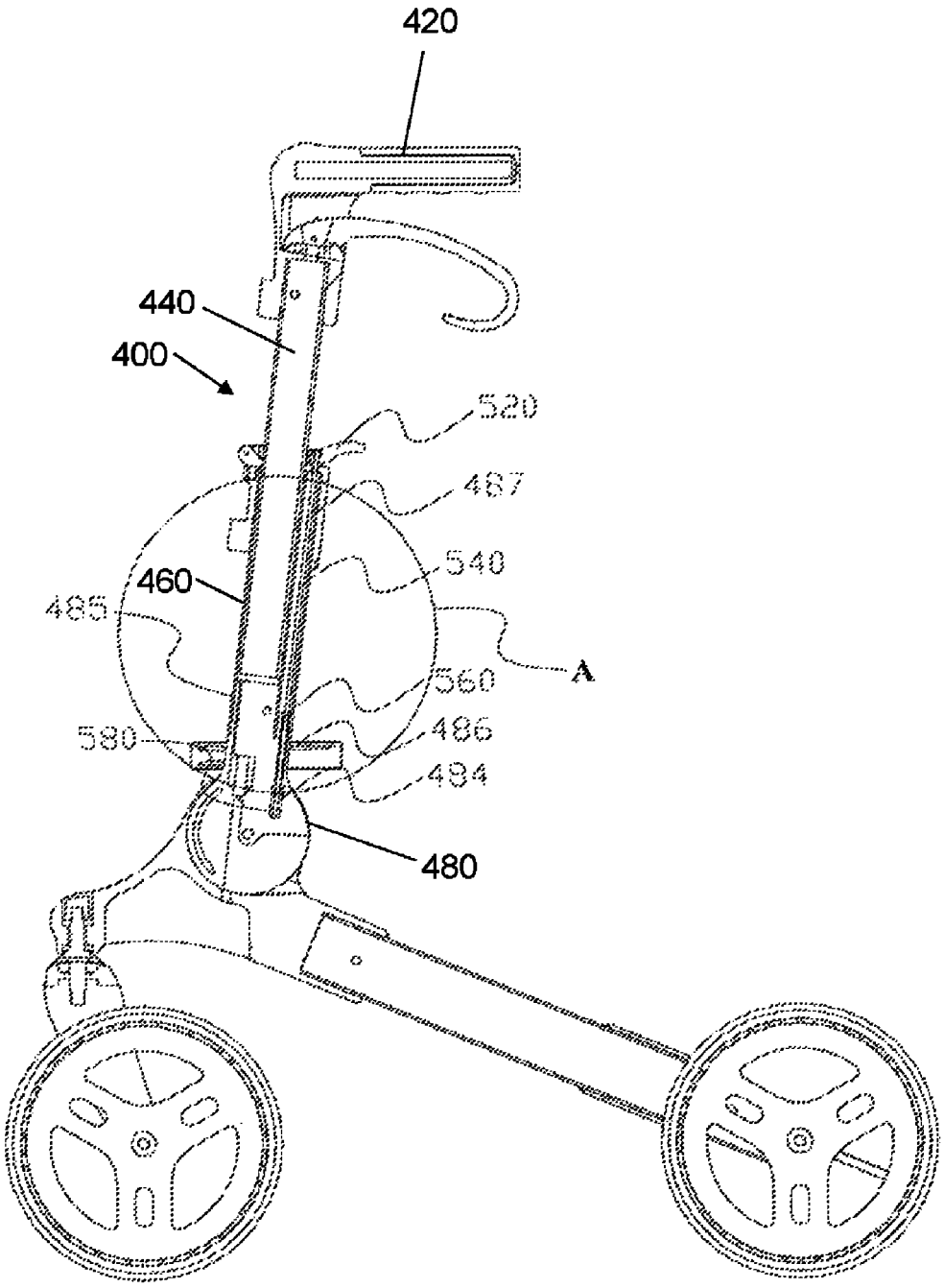
FIG. 2 is a side view showing a first rollator body according to one embodiment of the present disclosure.

As shown in FIG. 2, the gripping part 400 further includes a hand grip 420, the supporting bar includes an inner supporting bar 440 and an outer supporting bar 460, the outer supporting bar 460 is a hollow tubular structure, the inner supporting bar 440 is slidably fixed inside the outer supporting bar 460, and the hand grip 420 is fixed on the inner supporting bar 440 and positioned on an end of the inner supporting bar 440 away from the outer supporting bar 460. The hand grip 420 is fixed on the end of the inner supporting bar 440, and the inner supporting bar 440 slidably fixed inside the outer supporting bar 460 to scale, so it is convenient to adjust the height of the hand grip 420 according to the height of the user, and the user can use the foldable rollator in a comfortable position, to avoid bending down for operation which may cause physical power consumption and thus body aches and pains.

The gripping part 400 further includes a rotating member 480 detachably fixed on an end of the outer supporting bar 460, the rotating member 480 is provided with an annular slot 485, the annular slot 485 is arranged on an end of the rotating member 480 close to the outer supporting bar 460, and the outer supporting bar 460 is clamped in the annular slot 485. The steady engagement between the rotating member 480 and the outer supporting bar 460 can be implemented by providing the annular slot 485 on the end of the rotating member 480 facing towards the outer supporting bar 460, so that the foldable rollator has good overall structural strength.

Figure 3:
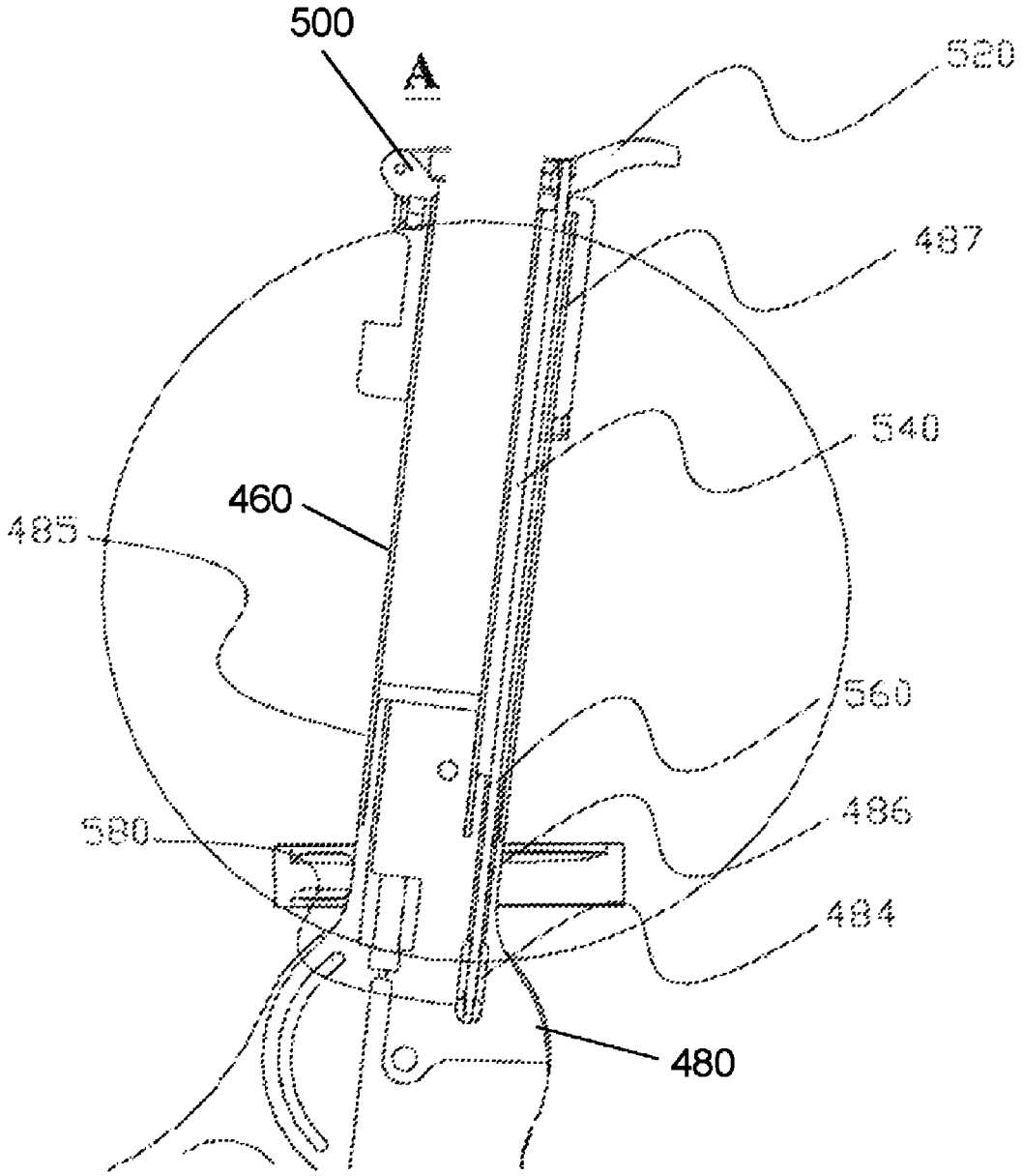
FIG. 3 is a partial enlarged view showing the A portion of the foldable rollator according to one embodiment of the present disclosure.
Figure 4:
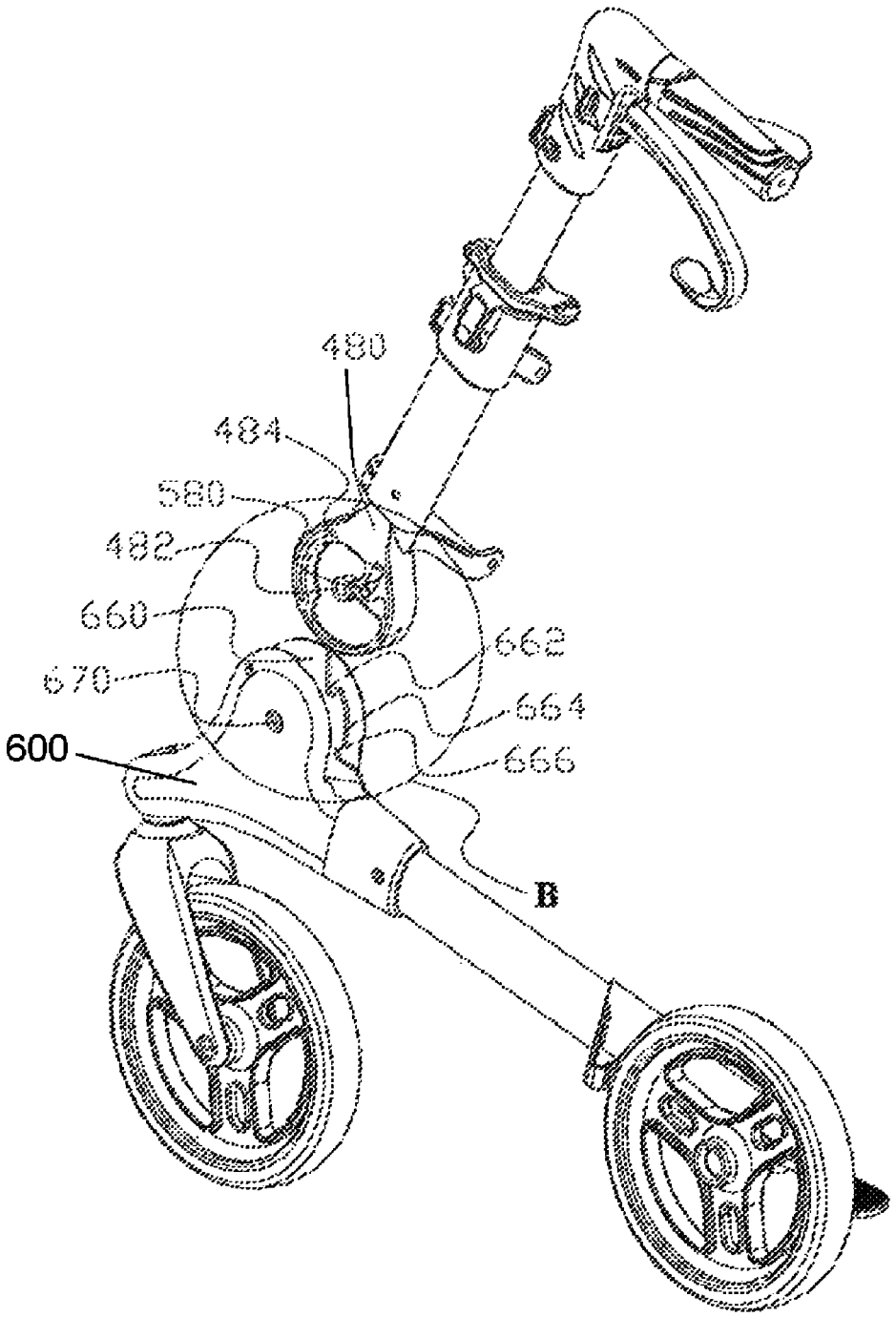
FIG. 4 is structural schematic diagram illuminating a first rollator body according to one embodiment of the present disclosure.

As shown in FIG. 3, the rotating member 480 is provided with a long hole 486 and a sliding groove 487, the drawing device 500 includes a drawing handle 520 fixed on the outer supporting bar 460, a drawing bar 540 arranged inside the sliding groove 487 and connected to the drawing handle 520, a spring 560 arranged inside the long hole 486 and connected to the drawing bar 540, and a detent 580 connected to the spring 560. It is convenient for the foldable rollator to use in practice that the drawing handle 520 is arranged at a height for the convenience of touching when the user is in a standing posture. That is, the drawing handle 520 may be drawn by the user to drive the drawing bar 540 to move upwards, the spring 560 may be driven by the drawing bar 540 to be under compression, and the detent 580 may be driven by the elastic force of the spring 560 to slide inside the long groove 484, so that each of the rotating member 480 and the supporting fastener 600 is in an active state, to rotate with respect to each other. Such transmission structure is simple and reliable, and easy to implement.

A long groove 484 penetrating the rotating member is arranged near the convex part 482, the detent 580 is slidably arranged in the long groove 484, both ends of the detent 580 extend out of the long groove 484, and the long hole 486, the sliding groove 487 and the long groove 484 are in communication with each other sequentially. The detent 580 is slidably fixed inside the long groove 484, and both ends of the detent 580 extend out of the long groove 484, so when the foldable rollator is in use, the relative positions of the gripping part 400 and the supporting fastener 600 can be fixed to prevent the separation between the gripping part 400 and the supporting fastener 600 caused by mis-shifted which may affect the normal use and cause a security problem. Meanwhile, the long hole 486, the sliding groove 487 and the long groove 484 are in communication with each other sequentially to form a channel, so it is convenient to mount the drawing device 500, and it makes various components of the drawing device 500 move accordingly, to implement the folding of the foldable rollator in the longitudinal direction.

Figure 5:
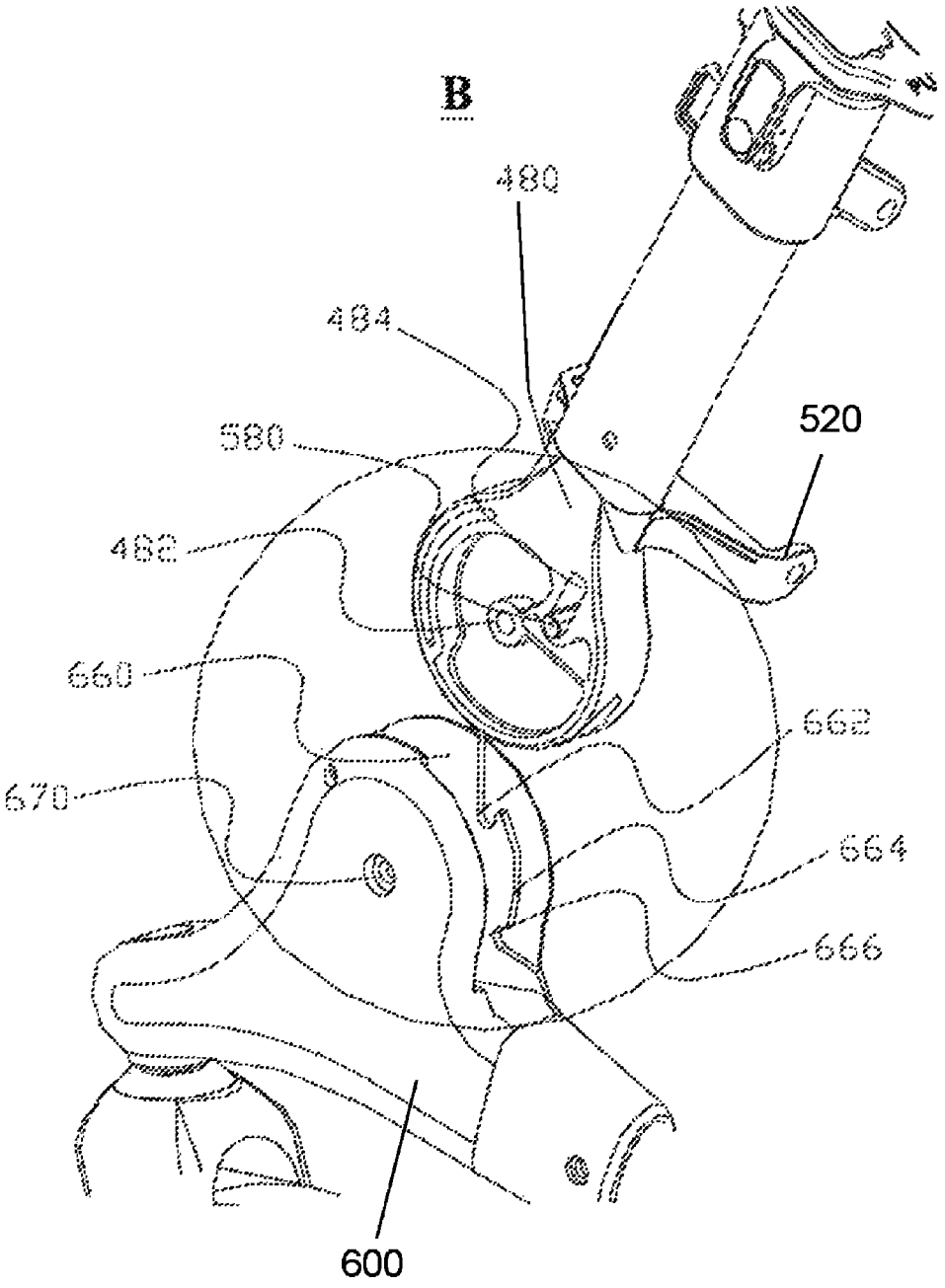
FIG. 5 is a partial enlarged view showing the B portion of the foldable rollator according to one embodiment of the present disclosure.
Figure 6:
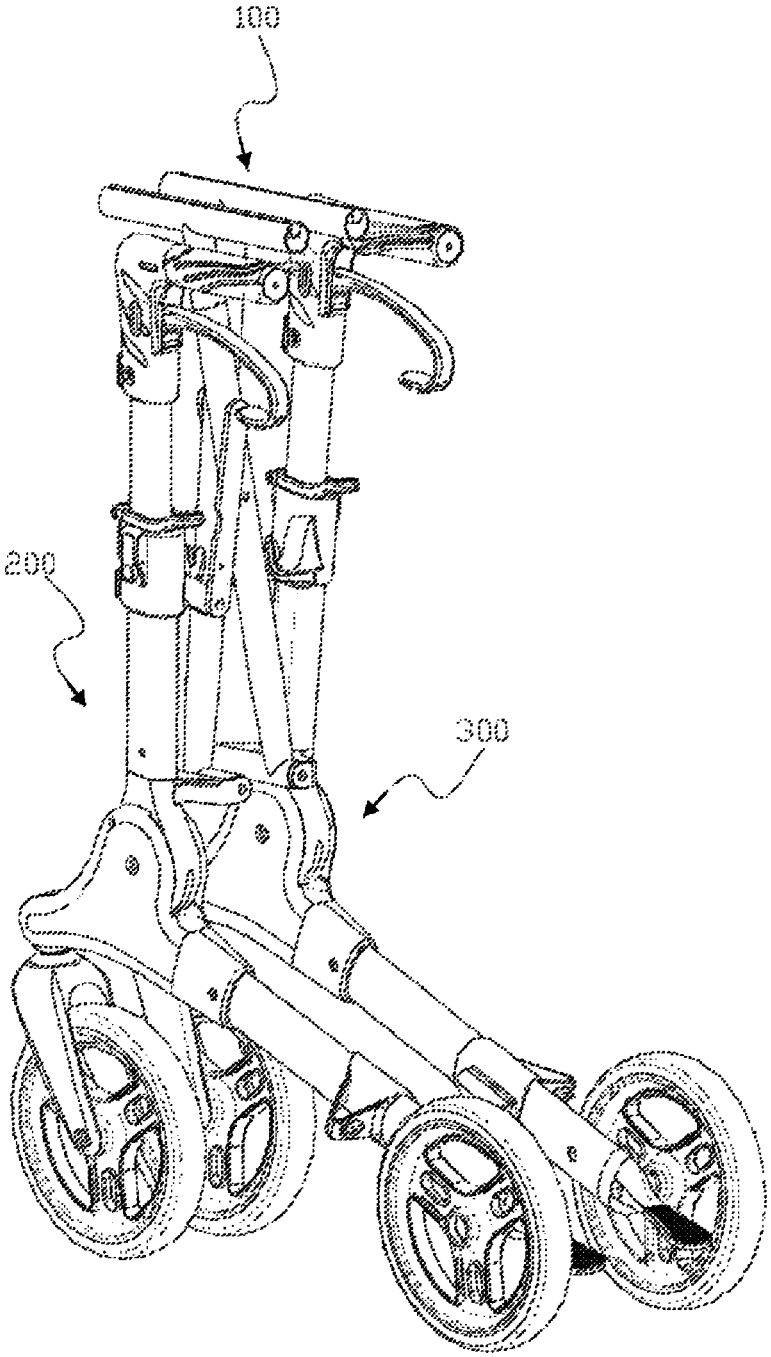
FIG. 6 is a schematic diagram illuminating a first folding state of the foldable rollator according to one embodiment of the present disclosure.
Figure 7:
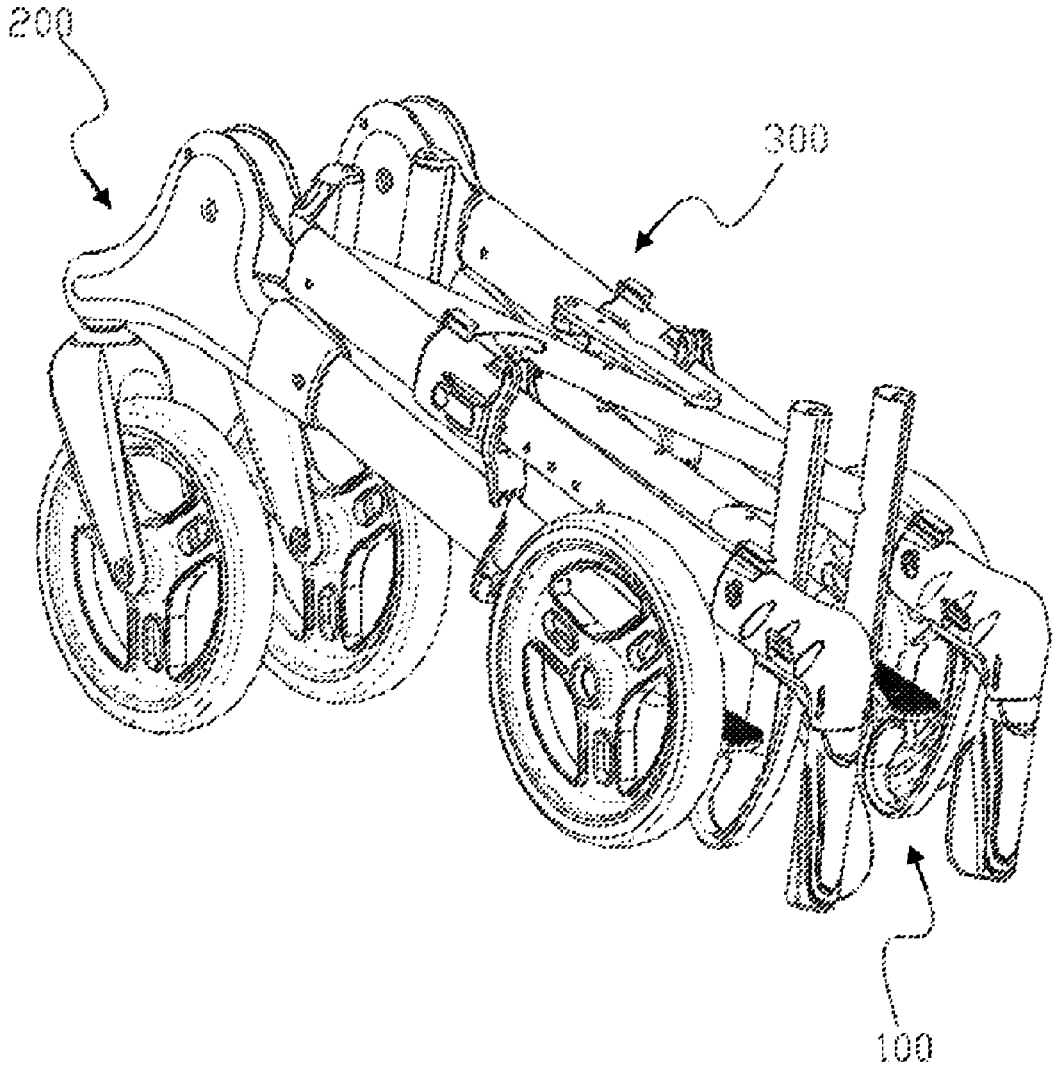
FIG. 7 is a schematic diagram illuminating a second folding state of the foldable rollator according to one embodiment of the present disclosure.

As shown in FIG. 5, the supporting fastener 600 is provided with a curved groove 660 fitted with the rotating member 480, each of both inner walls of the curved groove 660 is provided with the first clamping groove 662 and the second clamping groove 666 respectively, each of the both inner walls of the curved groove 660 is further provided with an arc segment 664 respectively, and the first clamping groove 662 and the second clamping groove 666 are connected with each other through the arc segment 664. In this preferred embodiment, each of the both inner walls of the curved groove 660 is provided with the first clamping groove 662, the arc segment 664 and the second clamping groove 666 respectively, and are symmetrically arranged in a mirror image orientation with respect to one another, so that both sides of the detent 580 can be fixed to ensure the stability of the connection. In practice the rotating member 480 is inserted into the curved groove 660, and at this time, the detent 580 is inserted into the first clamping groove 662, that is the gripping part 400 is perpendicular to the supporting fastener 600. When the foldable rollator needs to be folded after using, the drawing handle 520 may be drawn upwards to drive the detent 580 to move upwards to disengage from the first clamping groove 662, and then the gripping part may be rotated, so that the detent 580 slides along the arc segment 664 to slowly move to the second clamping groove 666. The detent 580 then may be clamped in the second clamping groove 666 through the resilience force of the spring 560, so that the rotating member 480 and the supporting fastener 600 can be fixed with respect to each other. Due to the elastic force of the spring 560, the detent 580 may be ensured to slide along the arc segment 664 with closely fitting with the arc segment 664, to complete the secondary folding. The above operations are convenient and efficient, and save both time and effort.

Each of both outer sides of the rotating member 480 is provided with a convex part 482 respectively, a side wall of the curved groove 660 is provided with a mounting through hole 670, and the convex part 482 is rotatably fixed inside the mounting through hole 670. The rotating member 480 is arranged at the end of the outer supporting bar contacting with the supporting fastener 600, and the convex part 482 is arranged on the side of the rotating member 480 contacting with the supporting fastener 600 to fit and be connected to the mounting hole provided on the supporting fastener 600, so it can achieve the rotation of the gripping part 400 to complete the secondary folding. In this preferred embodiment, the convex part 482 is provided with a threaded hole. The convex part 482 may be inserted into the mounting through hole 670 to be fastened with a screw or bolt, to ensure high stability of the connection between the rotating member 480 and the supporting fastener 600, to guarantee high overall strength of the foldable rollator. In other embodiments, other connection modes can be used, within the scope of the present disclosure.

Figure 8:
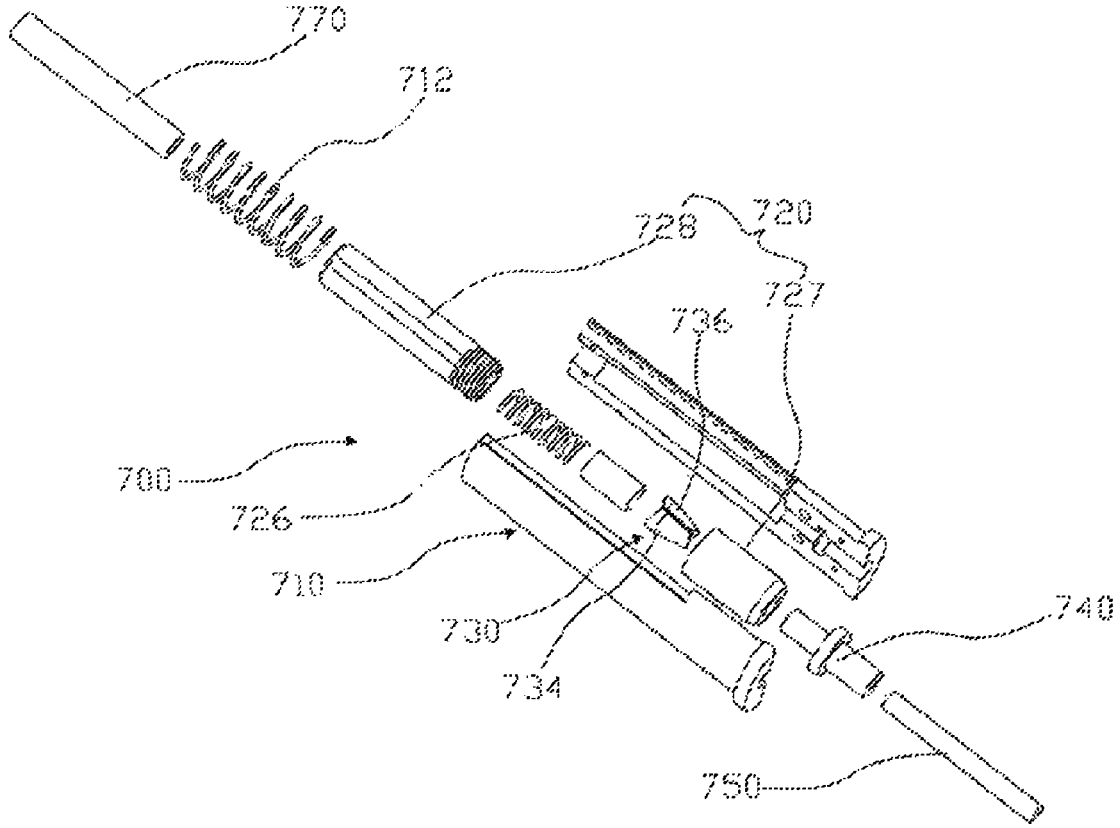
FIG. 8 is an exploded diagram of a braking device according to one embodiment of the present disclosure.
Figure 9:
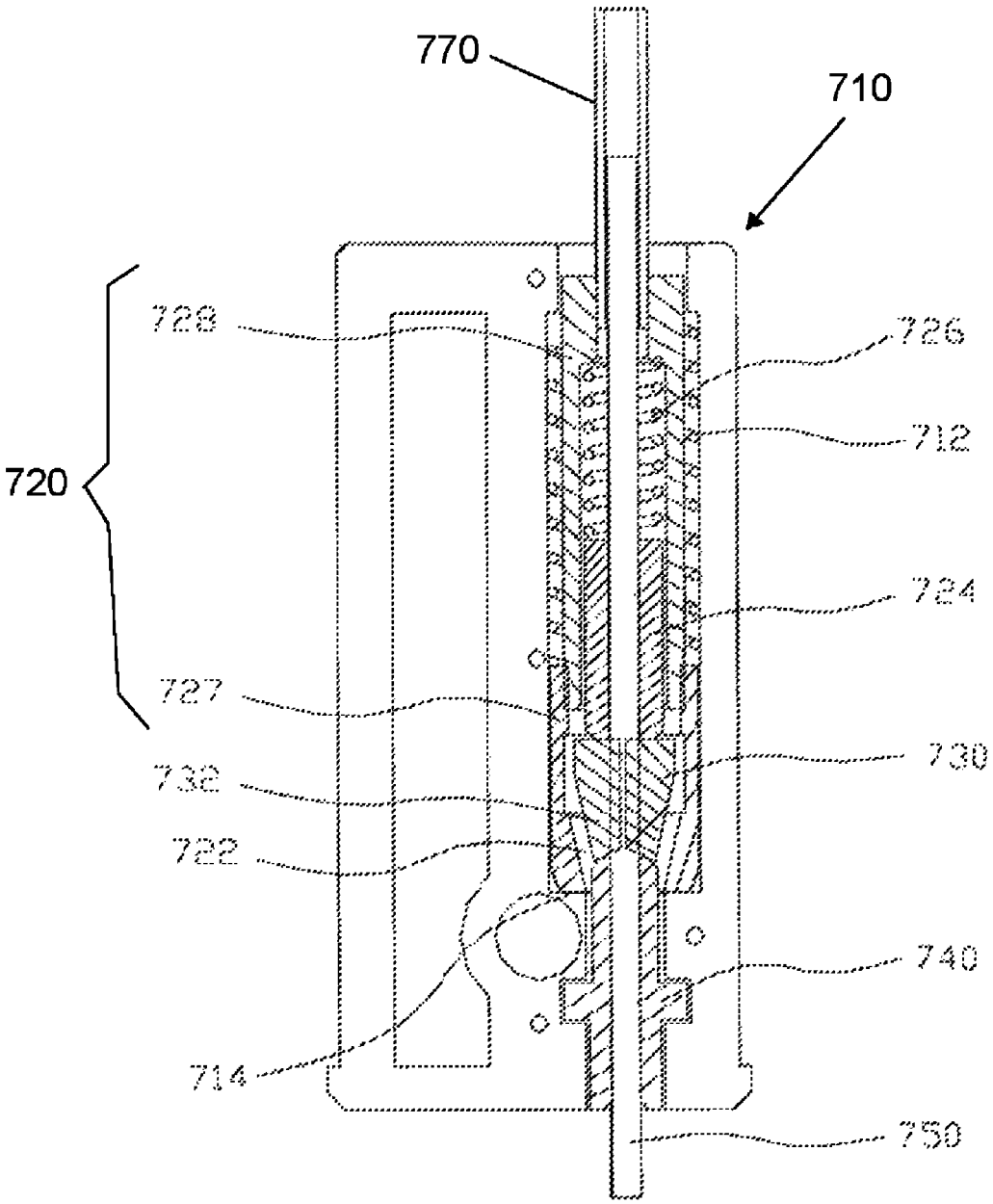
FIG. 9 is a schematic diagram illuminating a first state of the braking device according to one embodiment of the present disclosure.
Figure 10:
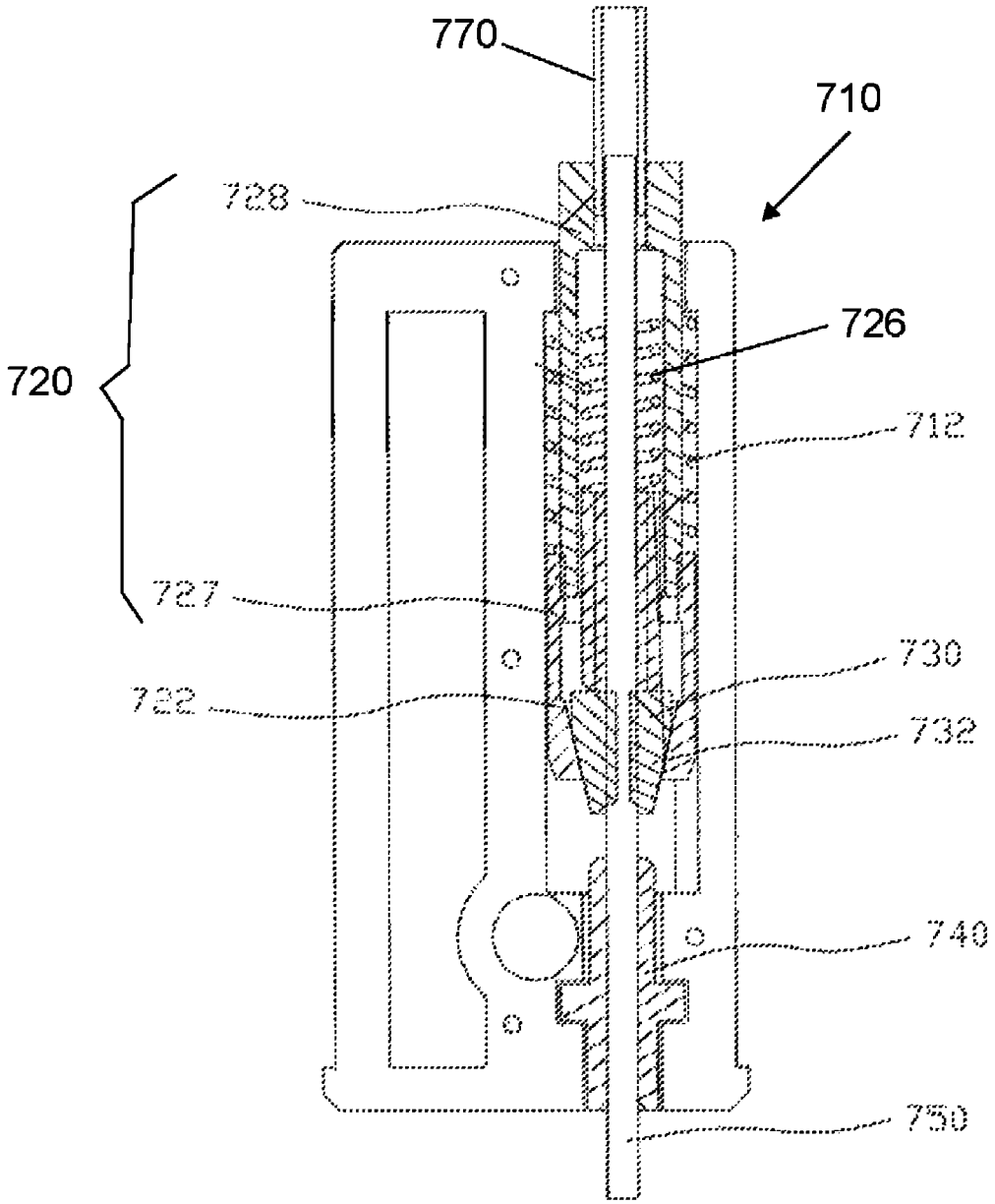
FIG. 10 is a schematic diagram illuminating a second state of the braking device according to one embodiment of the present disclosure.

Further, as shown in FIGS. 8-10 with continued reference to FIGS. 1 and 2, in one embodiment, the above foldable rollator further includes wheels 680, and a braking device 700 arranged on the gripping part 400, the gripping part 400 further includes a braking handle 490, and the braking device 700 includes a braking housing 710, a clamp housing 720, a clamp 730, a limit push rod 740, a braking rod 750, a braking pad 760 and a braking component 770.

One end of the braking component 770 is connected to the braking handle 490, the other end of the braking component 770 is connected to the clamp housing 720, the braking pad 760 cooperates with the wheels 680, the clamp housing 720 is arranged inside the braking housing 710, the clamp 730 is arranged inside the clamp housing 720, the clamp housing 720 includes a first housing 727 and a second housing 728 in threaded connection with each other, an inverted-conical cavity 722 is arranged at the bottom of the interior of the clamp housing 720, the clamp 730 is provided with an inverted-conical part 732 matching with the inverted-conical cavity 722, the limit push rod 740 is arranged at the bottom of the interior of braking housing 710, one end of the braking rod 750 is arranged inside the clamp housing 720, and the other end of the braking rod 750 is connected to the braking pad 760; when the braking device 700 is in a first state, one end of the limit push rod 740 abuts against the clamp 730, and is positioned inside the clamp housing 720, the inverted-conical cavity 722 is separated from the inverted-conical part 732, and the clamp 730 is opened; and when the braking device 700 is in a second state, the limit push rod 740 is separated from the clamp 730 and positioned outside the clamp housing 720, the inverted-conical cavity 722 matches with the inverted-conical part 732, and the clamp 730 is closed to clamp the braking rod 750.

When the foldable rollator is travelling, the braking device 700 is in the first state, and at this time, the inverted-conical cavity 722 is separated from the inverted-conical part 732, and the clamp 730 is in an opening state; and when the foldable rollator is braked, the braking handle may be turned upwards under external force, the braking component 770 may move upwards with the braking handle, and the clamp housing 720 may move upwards with the action of the braking component 770. After a certain displacement of the clamp housing 720, the inverted-conical cavity 722 of the clamp housing 720 may contact the inverted-conical part 732 of the clamp, and may continue to move upwards with the clamp housing 720, and the braking device 700 is in the second state (i.e., braking state). In this state, the clamp 730 may be under the action of the first compression spring, the inverted-conical cavity 722 may quickly fit the inverted-conical part 732, the clamp housing 720 may clamp the clamp 730, the clamp 730 may move upwards with the clamp housing 720, the limit push rod 740 may be separated from the clamp 730, the clamp 730 may clamp the braking rob 750 to move upwards together, and the braking rob 750 may act on the braking pad 760 to stop the wheels, achieve the purpose of quick braking. Due to the action of the resilient of both of the second compression spring 712 and the first compression spring 726, the clamp housing 720 and the clamp 730 may move downwards quickly, the clamp 730 may contact the limit push rod 740 firstly, the limit push rod 740 may stop the movement of the clamp 730, the clamp housing 720 may continue to move downwards to the limit step under the action of the second compression spring 712, the clamp 730 may be separated from the clamp housing 720 quickly, the clamp 730 may be opened, the braking rob 750 may be released, and the foldable rollator may continue to run.

As shown in FIG. 1, the above wheels 680 include a front wheel and a rear wheel. The supporting fastener 600 further includes a fixed part for front-wheel 620 and a fixed part for rear-wheel 640. The front wheel may be rotatably fixed on the fixed part for front-wheel 620, and the rear wheel may be rotatably fixed on the fixed part for rear-wheel 640. Two front wheels and two rear wheels are symmetrically mounted on the first rollator body 200 and the second rollator body 300, to ensure the travelling of the foldable rollator more steadily. In other embodiment, a structure with two wheels, three wheels or other appropriate numbers of wheels may be used, within the scope of the present disclosure. For the structure with three wheels, it includes one front wheel and two rear wheels arranged in a triangular configuration. The front wheel may be rotatably fixed on supporting fastener 600 through mounting a bearing, so that it is convenient to change the traveling direction of the foldable rollator with more convenience and less physical power, which is convenient for the operation of the aged people. In addition, in order to avoid the collision between the braking pad 760 and the feet during travelling, the braking pad 760 is preferably mounted on the fixed part for rear-wheel 640.

As shown in FIGS. 9 and 10, in one embodiment, a clamp pressure bar 724 and a first compression spring 726 are further arranged inside the clamp housing 720, the clamp pressure bar 724 is arranged between the clamp 730 and the first compression spring 726, and both ends of the first compression spring 726 abut against the clamp pressure bar 724 and the second housing 728 respectively. When the braking handle is adjusted to turn upwards for braking, the clamp housing 720 may move upwards under the action of the braking component 770. Since the first compression spring 726 is under compression, the first compression spring 726 may apply downward pressure on the clamp 730 through the clamp pressure bar 724, to make the inverted-conical part 732 of the clamp 730 quickly fit the inverted-conical cavity 722 of the clamp housing 720, to achieve the closure of the clamp 730 so that the clamp 730 clamp the braking rod 750 to move upwards together. The braking rod 750 may act on the braking pad 760 to stop the wheels, to achieve quick braking. When the braking handle is released, since the first compression spring 726 is under compression, the first compression spring 726 may move downwards quickly. The first compression spring 726 may apply downward pressure on the clamp 730 through the clamp pressure bar 724, making the clamp 730 move downwards quickly so that the clamp 730 contacts the limit push rod 740, and the clamp 730 may be separated from the clamp housing 720 quickly, to achieve the opening of the clamp 730. The braking rod 750 may be released to improve the sensitivity of the braking device 700.

In one embodiment, a second compression spring 712 is further arranged inside the braking housing 710, the second compression spring 712 is sleeved on the second housing 728, and both ends of the second compression spring 712 abut against the first housing 727 and the braking housing 710 respectively. Since the second compression spring 712 is under compression, when the braking handle is released, the second compression spring 712 may apply downward pressure on the clamp housing 720, the inverted-conical cavity 722 of the clamp housing 720 may fit the inverted-conical part 732 of the clamp 730, to make the clamp housing 720 and the clamp 730 quickly move downwards together. The clamp 730 may contact the limit push rod 740 firstly, the clamp 730 may stop moving, the second compression spring 712 may make the clamp housing 720 continue to move to the limit step, the clamp 730 may be separated from the clamp housing 720 quickly to achieve the opening of the clamp 730, and the braking rob 750 may be released to improve the sensitivity of the braking device 700.

Referring back to FIG. 8 with continued reference to FIGS. 9 and 10, the clamp 730 includes a first clamping part 734 and a second clamping part 736 arranged in a symmetrical manner, a clamping portion is arranged on an opposite side of each of the first clamping part 734 and the second clamping part 736 respectively, and the two clamping parts match with each other to clamp the braking bar 750. The closure or opening of the clamp 730 may be implemented by the first clamping part 734 and the second clamping part 736. The clamping portion is arranged on an opposite side of each of the first clamping part 734 and the second clamping part 736 respectively, and each of the two clamping portion is preferably a symmetrical groove matching with the periphery of the braking rob 750, to prevent the braking rob 750 from swinging freely within the clamp 730. The opposite side of each of the first clamping part 734 and the second clamping part 736 does not pass through the center of the inverted-conical part 732, to improve the clamping force of the clamp 730 on the braking rob 750, to make the braking system more stable.

Further, the clamp housing 720 may include a first housing 727 and a second housing 728. One end of the first housing 727 is provided with a inverted-conical cavity 722. One end of the second housing 728 is arranged on the other end of the first housing 727. The clamp housing 720 is composed by the first housing 727 and the second housing 728. The first housing 727 and the second housing 728 are connected through a screw thread, to facilitate the disassembling and replacing of the braking system.

In addition, in one embodiment, a limit step 714 is arranged inside the braking housing 710, one end of the limit push rod 740 abutting against the clamp 730 is arranged above the limit step 714, and the bottom of the first housing 727 abuts against the limit step 714.When the braking handle is released, both of the clamp housing 720 and the clamp 730 move downwards. Since the end of the limit push rod 740 abutting against the clamp 730 is arranged above the limit step 714, the clamp 730 may contact the limit push rod 740 firstly, the limit push rod 740 may stop the movement of the clamp 730, the clamp housing 720 may continue to move downwards, the clamp 730 may be separated from the clamp housing 720, the clamp 730 may be opened, the braking rod 750 may be released, and the clamp housing 720 may stop move after moving to contact the limit step 714. The periphery of the limit push rod 740 is provided with a flange, and a fixing groove matching with the flange is arranged at the bottom of the interior of the braking housing 710. When the clamp 730 moves downwards to abut on the limit push rod 740, due to the limit function of the limit push rod 740, the clamp 730 may be stopped to move downwards, so that the clamp 730 is separated from the clamp housing 720. In another embodiment, the braking housing includes a first braking housing and a second barking housing arranged in a symmetrical manner, so it is convenient for the disassembling and replacing of the braking device 700.

Technical features of the above embodiments may be combined arbitrarily. For brief description, not all of the possible combinations of the technical features of the above embodiments are described, but it will be appreciated that these possible combinations belong to the scope of the present disclosure once there is no conflict between the technical features.

The above are embodiments of the present disclosure described in detail, and should not be deemed as limitations to the scope of the present disclosure. It should be noted that variations and improvements will become apparent to those skilled in the art to which the present disclosure pertains without departing from its spirit and scope. Therefore, the scope of the present disclosure is defined by the appended claims.

What is claimed is:

1. A foldable rollator, comprising:

a folding device, and a first rollator body and a second rollator body, both of which are arranged having a mirror image orientation with respect to each other and movably connected with each other through the folding device, wherein each of the first and second rollator bodies includes a gripping part, a drawing device and a supporting fastener, the gripping part includes a supporting bar, the drawing device is arranged on the supporting bar and positioned away from the supporting fastener, the gripping part is rotatably connected to the supporting fastener, the supporting fastener is provided with a first clamping groove and a second clamping groove, the gripping part is perpendicular to and fixed to the supporting fastener when the drawing device is clamped in the first clamping groove, and the gripping part is rotationally connected to the supporting fastener when the drawing device is clamped in the second clamping groove.

2. The foldable rollator of claim 1, wherein the folding device includes a first connecting rod, and a second connecting rod rotatably fixed to the first connecting rod, the first connecting rod and the second connecting rod are arranged to cross each other, both ends of the first connecting rod are rotatably fixed to the first rollator body and the second rollator body respectively, and both ends of the second connecting rod are rotatably fixed to the first rollator body and the second rollator body respectively.

3. The foldable rollator of claim 1, wherein the gripping part includes a hand grip, the supporting bar includes an inner supporting bar and an outer supporting bar, the outer supporting bar is a hollow tubular structure, the inner supporting bar is slidably fixed inside the outer supporting bar, and the hand grip is fixed on the inner supporting bar and positioned on an end of the inner supporting bar away from the outer supporting bar.

4. The foldable rollator of claim 1, wherein the gripping part further includes a rotating member detachably fixed on an end of the outer supporting bar, the rotating member is provided with an annular slot, the annular slot is arranged on an end of the rotating member close to the outer supporting bar, and the outer supporting bar is clamped in the annular slot.

5. The foldable rollator of claim 4, wherein the rotating member is provided with a long hole and a sliding groove, the drawing device includes a drawing handle fixed on the outer supporting bar, a drawing bar arranged inside the sliding groove and connected to the drawing handle, a spring arranged inside the long hole and connected to the drawing bar, and a detent connected to the spring.

6. The foldable rollator of claim 4, wherein the supporting fastener is provided with a curved groove fitted with the rotating member, each of both inner walls of the curved groove is provided with the first clamping groove and the second clamping groove respectively, each of the both inner walls of the curved groove is further provided with an arc segment, and the first clamping groove and the second clamping groove are connected with each other through the arc segment.

7. The foldable rollator of claim 6, wherein each of both outer sides of the rotating member is provided with a convex part respectively, a side wall of the curved groove is provided with a mounting through hole, and the convex part is rotatably fixed inside the mounting through hole.

8. The foldable rollator of claim 7, wherein a long groove penetrating the rotating member is arranged near the convex part, the detent is slidably arranged in the long groove, both ends of the detent extend out of the long groove, and the long hole, the sliding groove and the long groove are in communication with each other sequentially.

9. The foldable rollator of claim 1, further comprising a supporting platform, wherein the supporting platform includes a first supporting tube, a second supporting tube arranged oppositely to the first supporting tube, and a flexible supporting member fixed on the first supporting tube and the second supporting tube, the first supporting tube and the second supporting tube are fixed on the folding member, and the flexible supporting member is provided with a drawing part.

10. The foldable rollator of claim 1, further comprising wheels, and a braking device arranged on the gripping part, wherein the gripping part further includes a braking handle, and the braking device includes a braking housing, a clamp housing, a clamp, a limit push rod, a braking rod, a braking pad and a braking component;

one end of the braking component is connected to the braking handle, the other end of the braking component is connected to the clamp housing, the braking pad cooperates with the wheels, the clamp housing is arranged inside the braking housing, the clamp is arranged inside the clamp housing, the clamp housing includes a first housing and a second housing in threaded connection with each other, an inverted-conical cavity is arranged at the bottom of the interior of the clamp housing, the clamp is provided with an inverted-conical part matching with the inverted-conical cavity, the limit push rod is arranged at the bottom of the interior of braking housing, one end of the braking rod is arranged inside the clamp housing, and the other end of the braking rod is connected to the braking pad; when the braking device is in a first state, one end of the limit push rod abuts against the clamp, and is positioned inside the clamp housing, the inverted-conical cavity is separated from the inverted-conical part, and the clamp is opened; and when the braking device is in a second state, the limit push rod is separated from the clamp and positioned outside the clamp housing, the inverted-conical cavity matches with the inverted-conical part, and the clamp is closed to clamp the braking rod.

11. The foldable rollator of claim 10, wherein a clamp pressure bar and a first compression spring are further arranged inside the clamp housing, the clamp pressure bar is arranged between the clamp and the first compression spring, and both ends of the first compression spring abut against the clamp pressure bar and the second housing respectively.

12. The foldable rollator of claim 10, wherein a second compression spring is further arranged inside the braking housing, the second compression spring is sleeved on the second housing, and both ends of the second compression spring abut against the first housing and the braking housing respectively.

13. The foldable rollator of claim 10, wherein a limit step is arranged inside the braking housing, one end of the limit push rob abutting against the clamp is arranged above the limit step, and the bottom of the first housing abuts against the limit step.

14. The foldable rollator of claim 10, wherein a flange is provided on the periphery of the limit push rob, and a fixing groove matching with the flange is arranged at the bottom of the interior of the braking housing.

15. The foldable rollator of claim 10, wherein the clamp includes a first clamping part and a second clamping part arranged in a symmetrical manner, a clamping portion is arranged on an opposite side of each of the first clamping part and the second clamping part respectively, and the first clamping part and the second clamping part match with each other to clamp the braking bar.

16. The foldable rollator of claim 12, wherein the braking housing includes a first braking housing and a second barking housing arranged in a symmetrical manner.

* * * * *